US006030133A

United States Patent [19]

Endo

[11] Patent Number: 6,030,133

[45] **Date of Patent: *Feb. 29, 2000**

[54] PRINTING APPARATUS COMPRISING PLURAL PRINTING UNITS

[75] Inventor: Katsuyuki Endo, Suwa, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/850,932

[22] Filed: Feb. 28, 1997

[30] Foreign Application Priority Data

Feb. 29, 1996 [JP] Japan ..... P8-043589

[51] Int. Cl.[7] ..... B41J 3/54; B41J 11/50

[52] U.S. Cl. ..... 400/82; 400/88; 400/605

[58] Field of Search ..... 400/604, 605, 400/607, 607.2, 608.2, 609, 613, 149, 82, 88, 71, 586, 578, 588; 101/692, 693; 347/49, 50, 138, 139, 148, 152, 170, 215, 222, 245, 262, 263, 264; 346/44

[56] References Cited

U.S. PATENT DOCUMENTS

| | | | |
|---|---|---|---|
| 4,527,285 | 7/1985 | Kekas et al. | 400/692 |
| 4,587,532 | 5/1986 | Asano . | |
| 4,727,245 | 2/1988 | Dobbins et al. | 400/88 |
| 4,747,707 | 5/1988 | Komori . | |
| 4,783,681 | 11/1988 | Tanaka et al. | 347/108 |
| 4,812,060 | 3/1989 | Pailler | 400/82 |
| 4,846,924 | 7/1989 | Morrison | 400/88 |
| 4,930,915 | 6/1990 | Kikuchi et al. | 400/692 |
| 4,951,564 | 8/1990 | Wilson et al. | 400/82 |
| 4,962,430 | 10/1990 | Hiroki et al. | 400/88 |
| 4,984,914 | 1/1991 | Hayakawa | 400/608.2 |
| 5,000,595 | 3/1991 | Kolki et al. | 400/613 |
| 5,013,168 | 5/1991 | Yokota et al. . | |
| 5,018,884 | 5/1991 | Hirano et al. | 400/82 |
| 5,033,887 | 7/1991 | Bäuerle | 400/692 |
| 5,044,801 | 9/1991 | Uchimura et al. . | |
| 5,067,832 | 11/1991 | Baur et al. | 400/692 |
| 5,122,073 | 6/1992 | Signore, II et al. | 400/692 |
| 5,129,750 | 7/1992 | Otsuki | 400/692 |
| 5,137,385 | 8/1992 | Kamimura et al. . | |

(List continued on next page.)

FOREIGN PATENT DOCUMENTS

| | | | |
|---|---|---|---|
| 0 195 949 | 10/1986 | European Pat. Off. . | |
| 0 359 580 | 3/1990 | European Pat. Off. . | |
| 0 392 643 | 10/1990 | European Pat. Off. . | |
| 362055146A | 3/1987 | Japan | 347/50 |
| 403150184A | 6/1991 | Japan | 400/578 |
| 403193451A | 8/1991 | Japan | 347/50 |
| 405031982A | 2/1993 | Japan | 400/578 |
| 5-124278 | 5/1993 | Japan . | |
| 405229185A | 9/1993 | Japan | 400/578 |

OTHER PUBLICATIONS

"Electromechanical Connector for Modular Terminal" IBM Technical Disclosure Bulletin, vol. 26, No. 6 Nov. 1983 pp2901–2902.

*Primary Examiner*—Eugene Eickholt

[57] ABSTRACT

A compact, easy-to-maintain printing apparatus features both receipt printing and journal printing and is capable of protecting data. Receipt printer 70 and journal printer 60 are mounted on a bottom housing 31 of the printing apparatus. Journal printer 60 comprises a separate chassis 65 and is removably mounted on a bottom housing 31. Two top housings 71 and 61 are provided, one hinged to the bottom housing 31, the other hinged to the chassis 65. The journal printer 60 is mounted behind the receipt printer 70 and the pivot for both covers is located near the rearward end of the bottom housing 31. When opened, top housing 71 for the receipt printer 70 rotates over journal printer 60, thereby assuring a wide open area above receipt printer 70. Top housing 61 of the journal printer 60 can be locked to bottom housing 31 by a keyed locking mechanism 81, thereby preventing improper operation of the journal printer 60 during maintenance.

46 Claims, 12 Drawing Sheets

U.S. PATENT DOCUMENTS

| | | | |
|---|---|---|---|
| 5,162,845 | 11/1992 | Ariyama et al. | 346/44 |
| 5,168,286 | 12/1992 | Okauchi et al. | 400/692 |
| 5,180,232 | 1/1993 | Chadima, Jr. et al. | 400/88 |
| 5,248,207 | 9/1993 | Yamamoto et al. | 400/613 |
| 5,320,437 | 6/1994 | Malke et al. | 400/605 |
| 5,331,580 | 7/1994 | Miller et al. | 400/88 |
| 5,361,694 | 11/1994 | Dubuit | 400/149 |
| 5,600,361 | 2/1997 | Dirx | 347/214 |
| 5,683,187 | 11/1997 | Tunmore | 400/82 |
| 5,684,518 | 11/1997 | Nobel et al. | 347/50 |
| 5,706,040 | 1/1998 | Reid et al. | 347/50 |
| 5,707,162 | 1/1998 | Kasai et al. | 400/692 |

Table 1

| $i_0$ \ $i_1$ | H | L |
|---|---|---|
| H | journal<br>impact-dot | label<br>impact-dot |
| L | journal<br>thermal | label<br>thermal |

PRINTING APPARATUS COMPRISING PLURAL PRINTING UNITS

BACKGROUND OF THE INVENTION

1. Field of the Invention

The present invention relates to a multiple function printing apparatus comprising plural printers and suited to constructing a point-of-sale (POS) station or similar information processing station, and relates particularly to a multiple function printing apparatus capable of simultaneous receipt printing and journal printing.

2. Description of the Related Art

Many POS stations in use today are assembled using a personal computer, display, cash drawer, printer, check reader, and other appropriate peripheral devices in a size suited to the scale of the store or check-out area or to meet the specific requirements of the counter arrangement and installation area. The printers used in such POS stations are commonly multiple function printers providing two printing functions, a receipt printing function for printing the receipts handed to customers, and a journal printing function for printing the sales journal retained by the store. FIG. 9 is an illustration of a typical POS station printer enabling both receipt printing and journal printing.

The printer 1 shown in this example comprises a receipt printing section 10 for printing receipts, and a journal printing section 20 for journal printing. Note that the receipt printing section 10 and journal printing section 20 are disposed horizontally side by side. The roll paper 11 for receipt printing is disposed toward the back of the printer 1 from the receipt printing section 10 such that receipt paper from roll paper 11 is supplied to the receipt printing section 10, the receipt is printed, and the roll paper receipt is then fed outside the printer 1 from the paper exit 2.

The roll paper 21 for journal printing is likewise disposed toward the back of the printer 1 from the journal printing section 20, and a take-up reel 22 for winding and holding the printed journal paper is housed further behind the roll paper 21. After the journal paper is fed from the roll paper 21 to the journal printing section 20 and printed, the paper is guided again toward the back of the printer 1 and taken up on the take-up reel 22.

With multiple function printers comprising plural printing units inside a single housing 9 the content, quantity, and application for the printed content typically differ with each printing unit.

Comparing journal printing and receipt printing, for example, receipt printing prints a receipt to be handed immediately to the customer, and therefore requires the sales information and store name, and possibly other desired information to be printed, and the roll paper is then fed far enough to eject the entire printed content outside the printer so that a receipt can be cut off by a cutter. Journal printing, however, does not require printing of the store name and other non-sales related information, and does not need to feed the roll paper more than is required to print the sales information.

As a result, more roll paper 11 is consumed for receipt printing than roll paper 21 is consumed for journal printing, and receipt printing roll paper 11 therefore requires more frequent replenishment.

With the printer shown in FIG. 9, top housing 9*a*, which is common to receipt printing section 10 and journal printing section 20, must be opened every time the receipt printing roll paper 11 is replaced. As replacing roll paper 11 is also a task performed frequently by the operator, it is not desirable to open the entire top of printer 1 to replace roll paper 11 because this can leave a poor impression on the customer and creates greater opportunities for dust and other foreign matter to get inside printer 1. In addition, the printed sales journal contains data used by the store owner for accounting and other purposes. Exposing such information to the customer's view is not desirable, and accidental removal or replacement of the journal paper by the operator when replacing the receipt printing paper could create accounting and other business problems.

As a result the top housing may be divided into a part covering the receipt printing unit and another part covering the journal printing unit so that only the cover relevant to the roll paper that must be replaced needs to be opened. With printer 1 shown in FIG. 9, for example, top housing 9*a* could be divided into two parts opening right and left. This, however, limits the openable area and makes it more difficult to replace the roll paper.

Depending upon what each printing unit is used for, it may also be desirable to use different types of printing units in a multiple function printer. For example, a thermal transfer printer may be sufficient for the receipt printing unit because the printed receipts are simply passed to the customer, but the printed journal may be used for multiple purposes including accounting and purchasing. It may therefore be preferable to use an impact type printer for journal printing to print multiple copies. However, manufacturing multiple function printers offering various combinations of printing units according to individual user requirements is more difficult and time consuming, thus increasing the unit cost.

OBJECTS OF THE INVENTION

An object of the present invention is to solve the above problems of the prior art and to facilitate combining various types of printing units (subprinters) in one printer body in accordance with user demand, thus lowering the device price and shortening the turn-around-time of the printer products.

SUMMARY OF THE INVENTION

To achieve the above object and other objects of the invention, a printing apparatus according to the invention comprises plural printing units for printing on plural different recording media and a first main housing for housing the plural printing units wherein each printing unit comprises a recording medium transportation means for transporting the recording medium, a printing means for printing on the recording medium, and a platen opposing the printing means with the recording medium disposed therebetween. In the printing apparatus the first printing unit of the plural printing units comprises a second housing for housing at least the recording medium transportation means, printing means, and platen, and is removable from the printing apparatus first main housing. The printing means of the plural printing units are further characterized by being interchangeable and by being of different types.

The printing apparatus of the invention is further characterized by comprising a common control means disposed in common with the plural printing units for receiving data sent from a host device, and the first printing unit comprising a connecting means connected to the common control means for the input of print data from the common control means. The common control means is further characterized by comprising a connection detecting means for detecting whether the connecting means is connected. The connection detecting means is further characterized by comprising a printing unit detection means for detecting the type of the first printing unit.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The preferred embodiment of the present invention is described below with reference to the accompanying figures.

Figure 1:
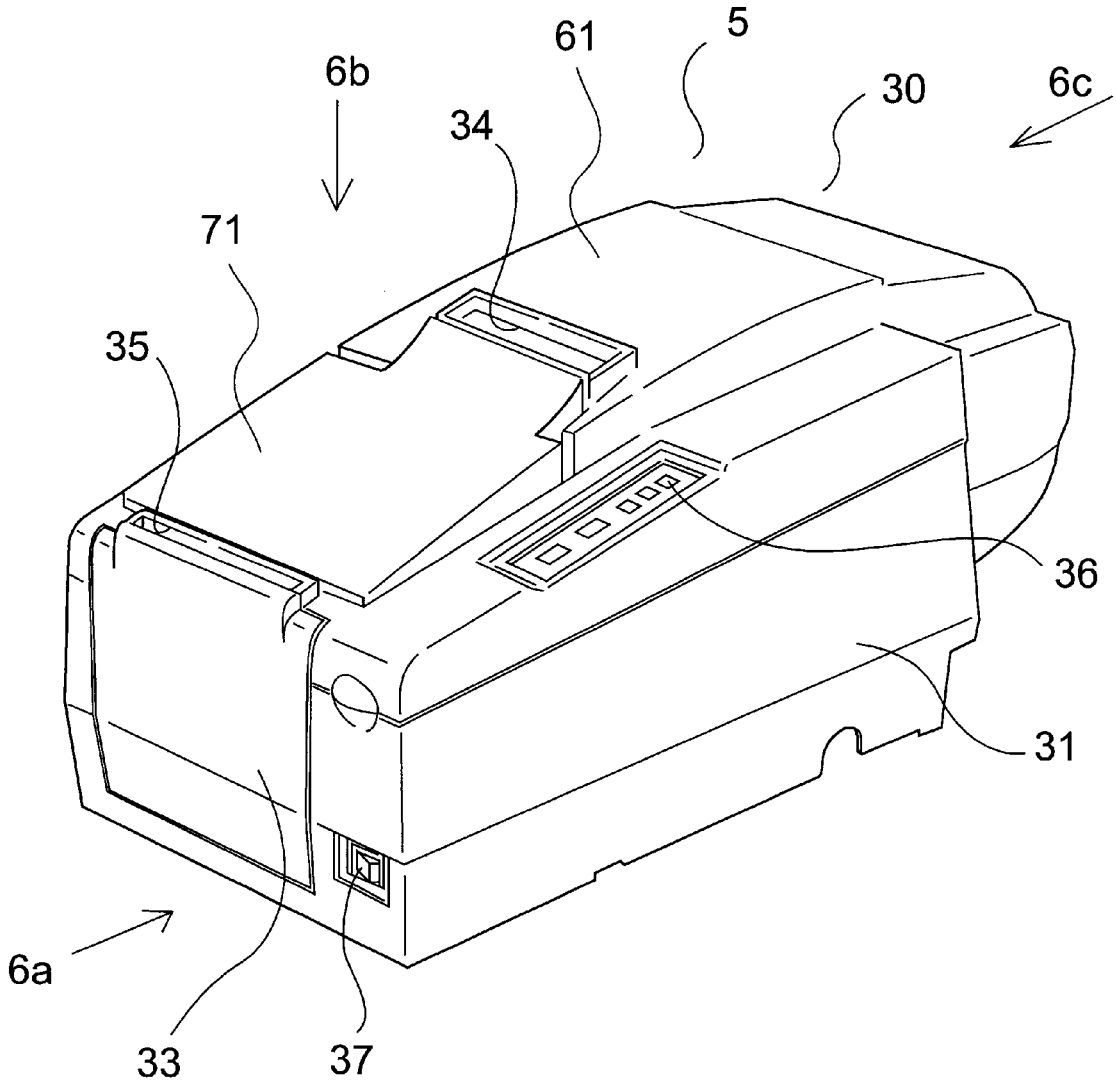
FIG. 1 is an external overview of a printer according to the preferred embodiment of the invention.
Figure 2:
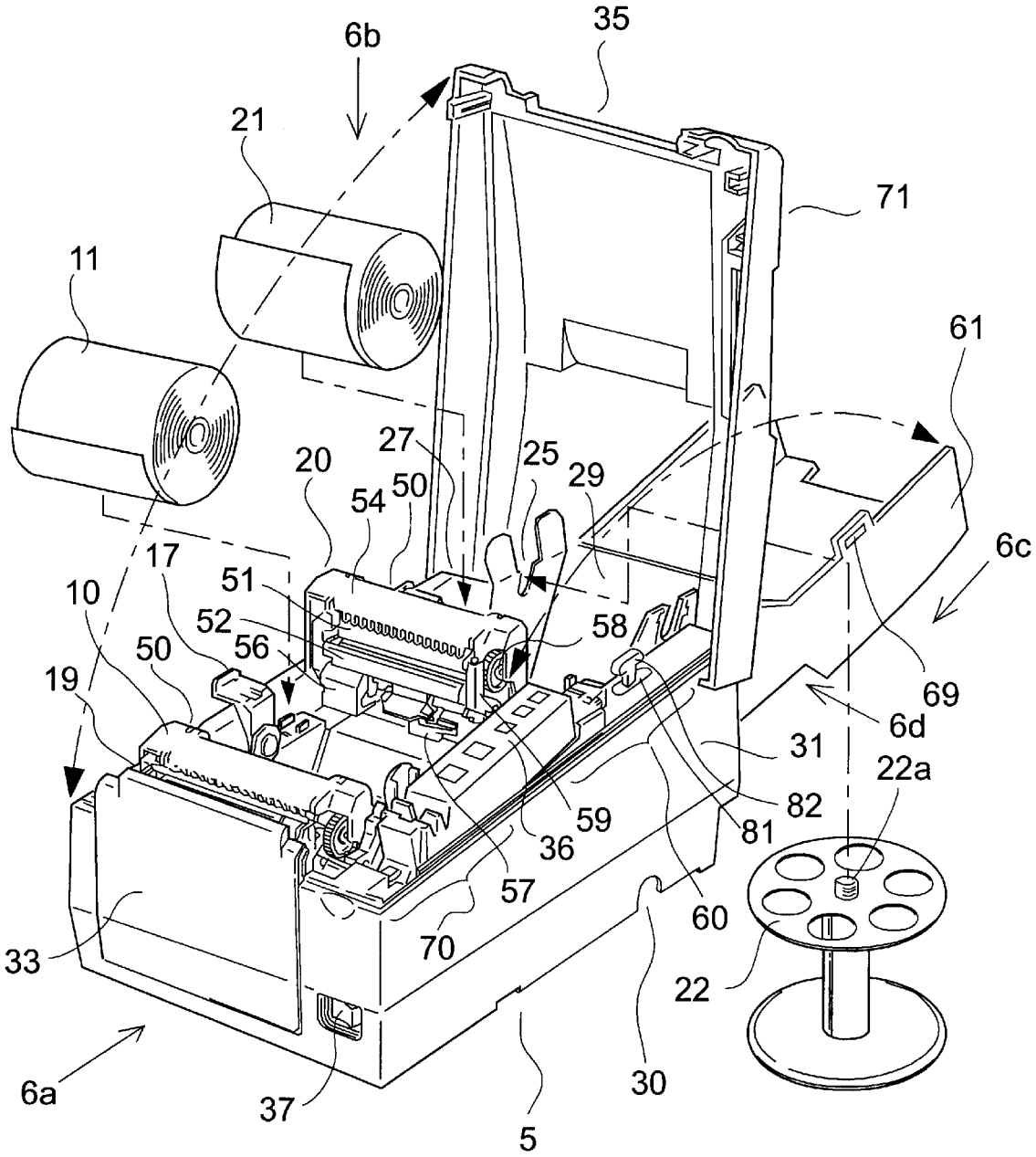
FIG. 2 is an overview of the printer shown in FIG. 1 with the top housing thereof open.

FIG. 1 is an external overview of a printer 5 according to the preferred embodiment of the invention. FIG. 2 is an overview of the printer 5 with the top housing thereof open, and FIG. 3 is a side cross sectional view of the printer 5.

As shown in the figures, the printer 5 according to the present embodiment has a rectangular parallelepiped shape that is long from the front 6*a* to the back 6*c* with the overall unit enclosed in a main housing 30 made of plastic, for example. This main housing 30 comprises a bottom housing 31 for housing the various mechanisms of the printer 5, top housings 61 and 71 that are openable upward from the bottom housing 31 to top 6*b* of printer 5, and a housing front 33 that is openable toward the front 6*a* of printer 5. A monitor window 34 enabling the user to check the results of journal printing and to physically write on the printed journal paper is disposed at approximately the top center of printer 5 near the front end of top housing 61. When housing front 33 is closed on bottom housing 31, paper exit 35 is formed by the combination of the front and bottom housings.

A cut-out opening is also formed in the right side of the front top housing 71 to expose the operating panel 36 disposed on bottom housing 31. The operating panel 36 and a power switch 37 disposed in the front 6*a* of bottom housing 31 enable manual control of printer 5 according to the present embodiment.

Figure 3:
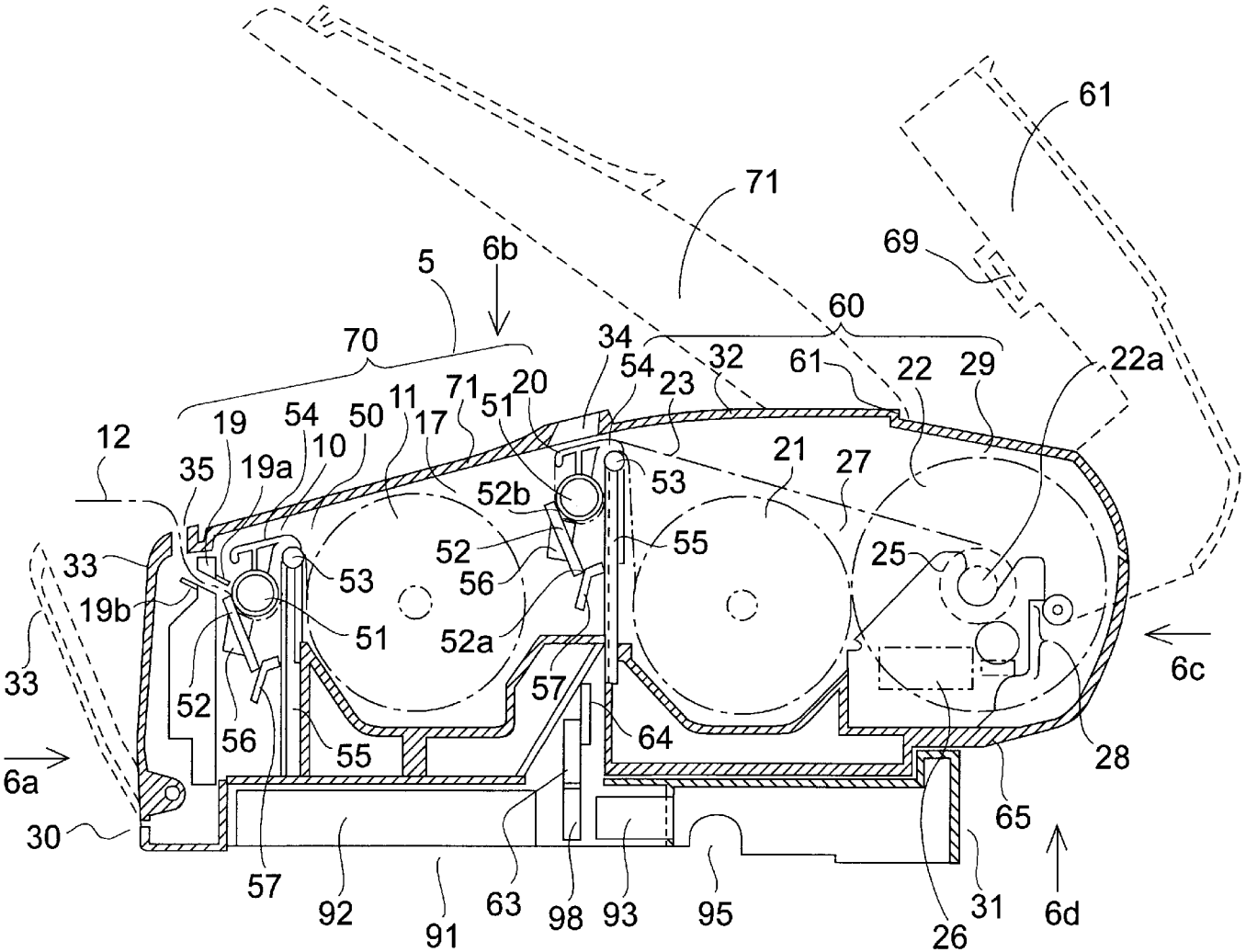
FIG. 3 is a side cross sectional view of the printer shown in FIG. 1.

As shown in FIG. 2 and FIG. 3, printer 5 according to the present embodiment comprises two subprinters 60 and 70 disposed in series one behind the other from front 6*a* to back 6*c* of printer 5. The front subprinter 70 is a subprinter (receipt printer) for receipt printing, and comprises in sequence from front 6a automatic paper cutter 19 for automatically cutting off the receipt after printing, receipt printing section 10 for printing the receipts, and roll paper housing 17 for storing the roll paper 11 used for receipt printing. The back subprinter 60 is the subprinter journal printer) for journal printing, and comprises in sequence from front 6*a* journal printing section 20 for journal printing, roll paper housing 27 for storing the roll paper 21 used for journal printing, and take-up reel housing 29 for storing the take-up reel 22 onto which the journal printing roll paper is wound after journal printing.

The tops of journal printer 60 and receipt printer 70 are separately covered by respective top housings 61 and 71 which pivot open on bottom housing 31 at back 6*d* of journal printer 60 behind receipt printer 70.

Locking mechanism 81, providing a keyed lock securing top housing 61 covering journal printer 60 to bottom housing 31, is also disposed at the back of bottom housing 31 on which journal printer 60 is mounted. Slit 69 is provided in the side of top housing 61 at a position opposite locking mechanism 81 for engaging a lock plate (not shown in the figures) that is moved in and out of bottom housing 31 by locking mechanism 81. By then closing top housing 61 on bottom housing 31 and operating key 82 in locking mechanism 81, top housing 61 is locked closed on bottom housing 31. As a result, roll paper 21 housed in journal printer 60 and the printed journal paper taken onto take-up reel 22 are protected, and journal printer 60, which can be mounted on and removed from bottom housing 31 as described below, is simultaneously locked to bottom housing 31.

As also shown in FIG. 3 identically constructed printing mechanisms 50 are used in both receipt printing section 10 of receipt printer 70 and journal printing section 20 of journal printer 60 of the printer 5 according to the present embodiment.

The printing mechanisms 50 comprise a platen roller 51, thermal head circuit board 52 for pressing a heat-sensitive recording paper against platen roller 51 and printing on the recording paper, and guide roller 53 for guiding the roll paper to the platen roller 51. These components are mounted on a support base 55 and mounted thereby substantially perpendicularly to and inside bottom housing 31. Platen roller 51 and motor 56 are also disposed on the left side of support base 55 as seen from front 6*a*. Motor 56 is connected to platen roller 51 by means of a gear set not shown in the figures to rotationally drive platen roller 51 at a given speed.

Knob 58 and release lever 59 are also disposed on the right side of platen roller 51 as seen from front 6*a*. Knob 58 is used to manually rotate platen roller 51, and release lever 59 is used to release motor 56 and thereby reduce the load when manually turning platen roller 51 using knob 58.

A guide plate 54 for guiding the paper toward the back of the printer is mounted above platen roller 51.

On the edge 52*a* of thermal head circuit board 52 opposite that which contacts platen roller 51 is fastened a lever 57 for opening the printing means. When the lever 57 is rotated, thermal head circuit board 52 is separated from platen roller 51, thus opening wide and exposing the recording medium path inside printing mechanism 50 to the outside. When a paper jam occurs inside printing mechanism 50, lever 57 can be operated to open the recording medium path and enable the jammed paper to be easily removed.

Receipt paper 12 is fed by guide roller 53 from receipt printing roll paper 11 housed in roll paper housing 17 positioned behind receipt printing section 10 to the printing mechanism 50 disposed in receipt printing section 10. The receipt paper 12 is then guided to platen roller 51, and advanced by the rotation of platen roller 51 to the printing part 52*b* of thermal head circuit board 52 for receipt printing. The printed receipt paper 12 is then guided to cutter 19*b* of automatic paper cutter 19 by guide vane 19*a*, which extends from automatic paper cutter 19 positioned at the front of receipt printing section 10 toward platen roller 51. After passing cutter 19*b*, receipt paper 12 is ejected outside printer 5 from paper exit 35 in the front of housing 30. When printing on receipt paper 12 by receipt printing section 10 is completed, receipt paper 12 is thus ejected from printer 5 and automatically cut by cutter 19*b* of automatic paper cutter 19 to form a printed receipt that can be handed to the customer.

Journal paper 23 is similarly supplied by guide roller 53 to platen roller 51 of printing means 50 mounted in the journal printing section 20 from roll paper 21 held in journal printing roll paper housing 27 disposed behind the printing means 50. The journal paper 23 is likewise advanced by the rotation of platen roller 51 to the printing part 52*b* of thermal head circuit board 52 for journal printing, and is transported over guide plate 54 to the back of platen roller 51. The printed journal paper 23 is then taken up on take-up reel 22 disposed in take-up reel housing 29 behind roll paper housing 27. To drive take-up reel 22 and wind the printed journal paper 23 onto the take-up reel 22, a reel support 25 supporting shaft 22*a* of take-up reel 22, motor 26 for rotationally driving take-up reel 22, and power transfer gear set 28 are disposed in take-up reel housing 29.

Monitor window 34 enabling the operator to visually confirm the content printed on journal paper 23 is disposed approximately above guide plate 54 of printing mechanism 50. With the guide plate 54 also functioning as a writing pad, monitor window 34 also enables the operator to write on the journal paper to add memos, sign the journal, or correct printing errors. The printing mechanism 50 of the journal printing section 20 of the present embodiment is positioned slightly higher than that of the receipt printing section 10, thereby bringing the journal paper 23 as close as possible to monitor window 34. This improves the visibility of the paper through monitor window 34, and makes it easier to write on the paper.

A control circuit board 92 for passing print data to the journal printer 60 and receipt printer 70 and controlling these subprinters, and connectors 93 for communicating data and control signals between the subprinters and external devices, are housed in control circuit board installation space 91 in the bottom of bottom housing 31. The control circuit board 92 and connectors 93 are disposed primarily below receipt printer 70 at the front of housing 30, and all connectors 93 are oriented facing back 6*c* of printer 5.

Figure 4:
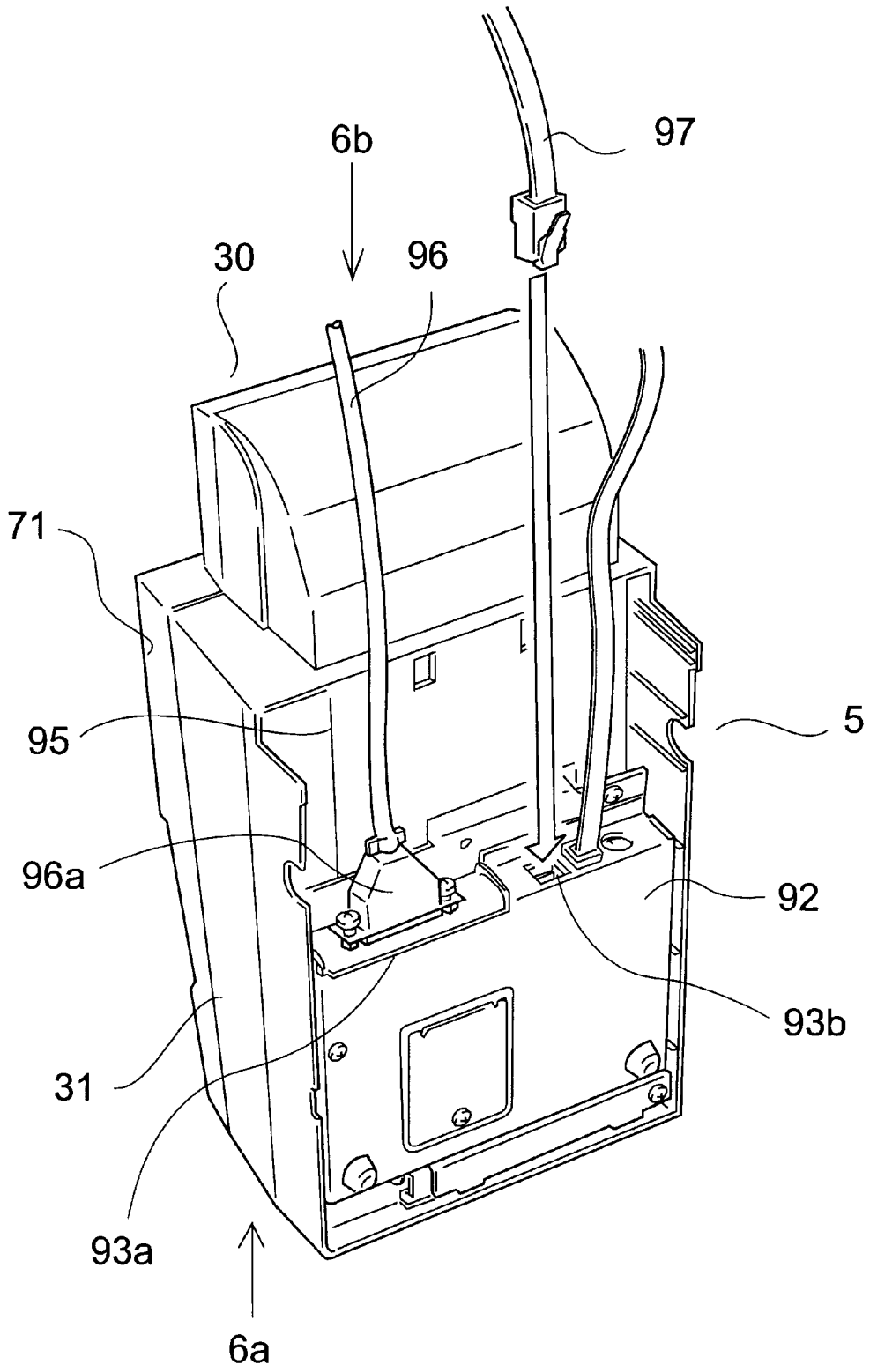
FIG. 4 is a bottom view of the printer shown in FIG. 1.

The side walls only of printer 5 are extended downward below journal printer 60 to create a housing area 95 for any cables. As shown in FIG. 4, print data and control signal cables 96 and 97 can be connected to connectors 93*a* and 93*b* using this cable housing area 95. This enables printer 5 according to the present embodiment to be placed tight against a wall or other device without cable connectors 96*a* protruding from the back of printer 5.

Because the cable connectors are not externally exposed and the cables can be held in housing area 95 and connected without excessively bending the cables, the cables are less likely to disconnect from the printer-side connector jacks, and shorts and other problems arising from tightly bending the cables can be prevented.

Figure 10:
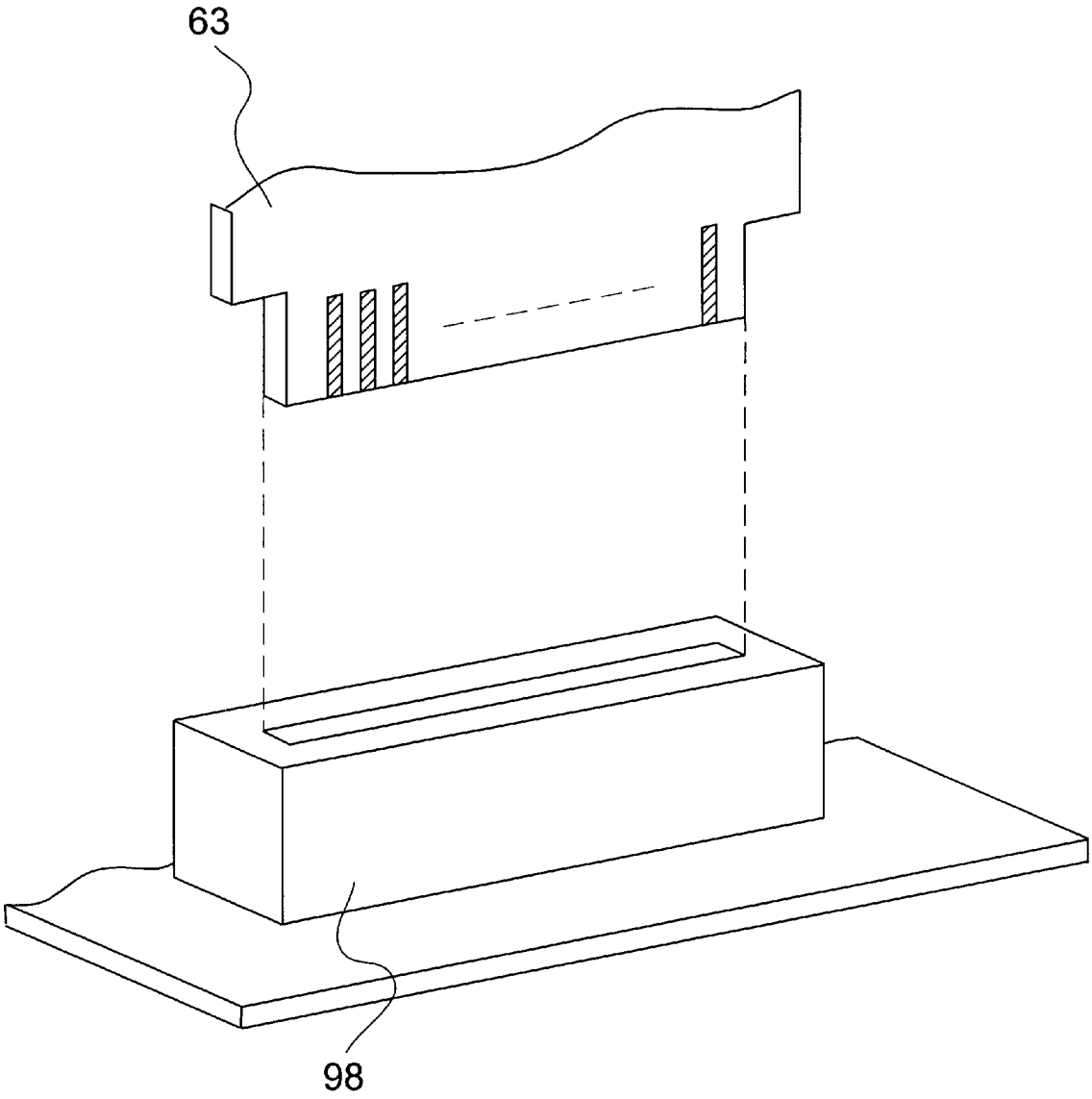
FIG. 10 is perspective view of the input connector of the separable subprinter housing and the output connector of the main printer housing.

Referring again to FIG. 3 and to FIG. 10, journal printer 60 of printer 5 according to the present embodiment has a separate bottom housing (chassis) 65, and can be mounted in the back of main bottom housing 31 in which the control circuit board is provided. The complete printing mechanism 50 constituting journal printer 60 is assembled on this separate chassis 65, and top housing 61 is disposed to pivot on the back of chassis 65. Input connector 63 for obtaining print data through interface circuit board 64 is also provided in front of printing mechanism 50, and moves together with chassis 65 as a result of its connection to interface circuit board 64. An output connector 98 enabling connection to input connector 63 is provided in the bottom of main bottom housing 31 of printer 5 such that when journal printer 60 is installed in main bottom housing 31, output connector 98 of main bottom housing 31 and input connector 63 of journal printer 60 connect to enable data communications. When journal printer 60 is removed from bottom housing 31, input connector 63 moves with chassis 65 so that input connector 63 disconnects from output connector 98.

Figure 11:
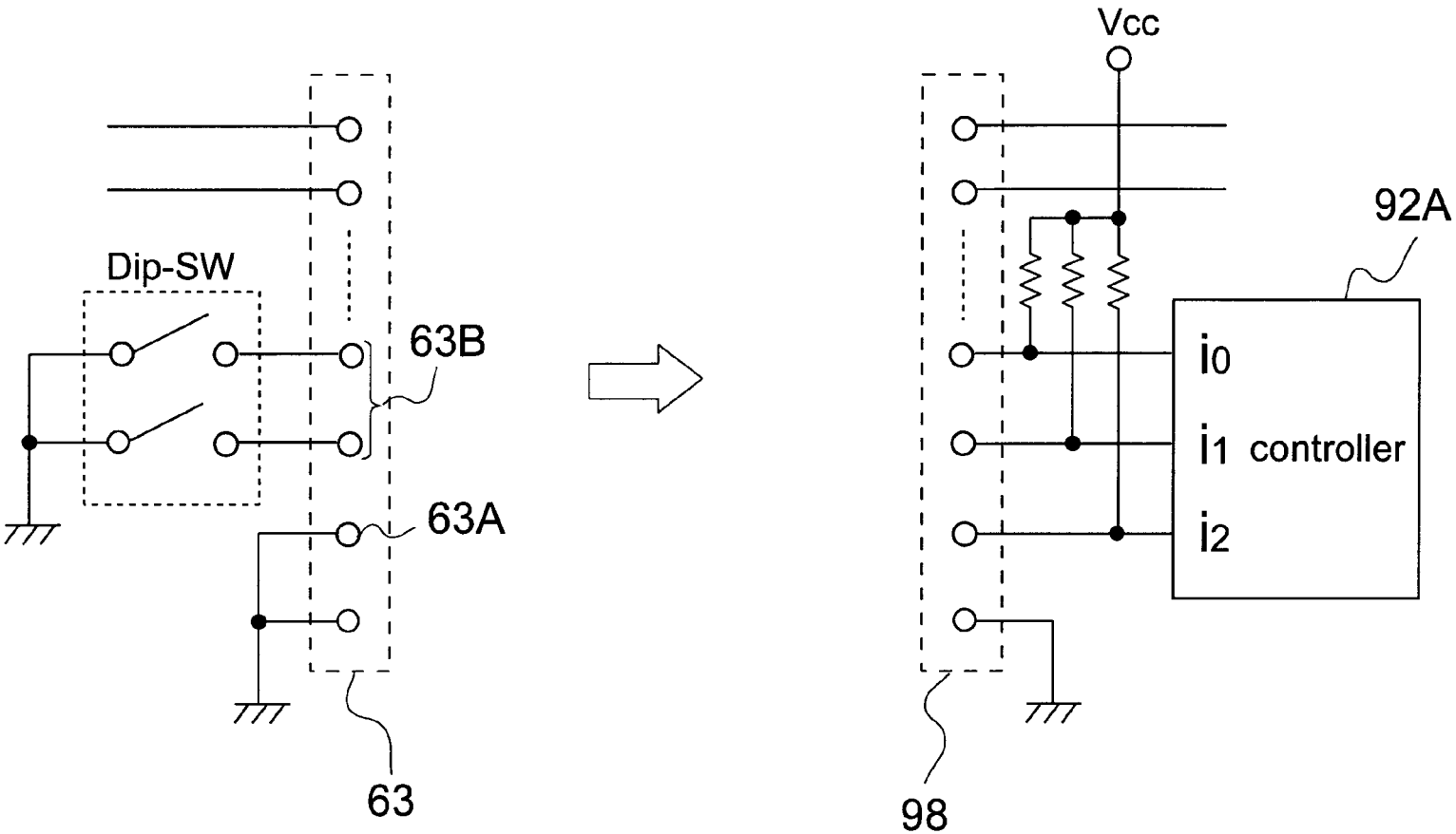
FIG. 11 is a schematic diagram of the connection detection terminal and printer-type terminals of the input and output connectors.
Figure 12:
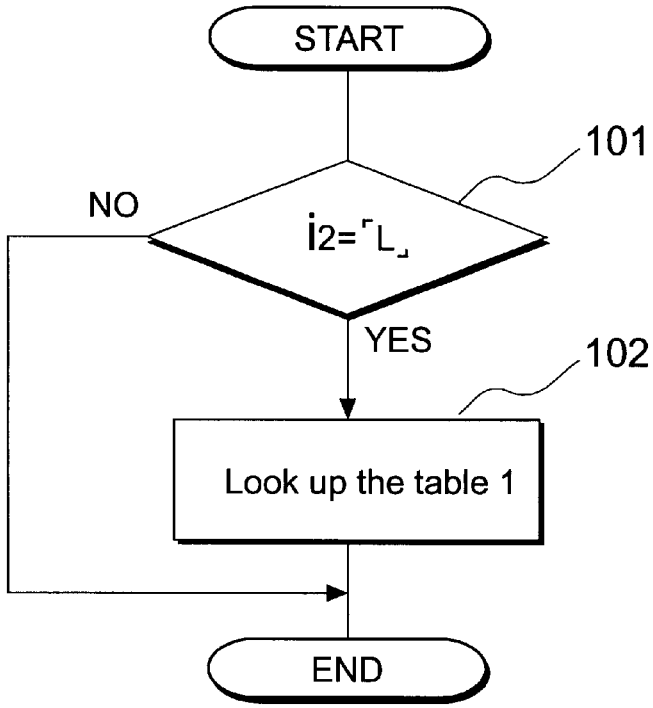
FIG. 12 is a flow chart and associated look-up table for connection and printer-type detection.

As shown in FIG. 11, a connection detection terminal 63A is also provided on input connector 63. A controller 92A, provided on control circuit board 92 of printer 5 for processing print data and controlling the printer mechanisms based on the processed print data, detects the voltage level of a terminal input of output connector 98, which corresponds to the connection detection terminal 63A of input connector 63 and is connected to an input terminal i2 of controller 92A. Printer 5 can therefore detect whether journal printer 60 is installed and connected by detecting the voltage level of this terminal 63A through the terminal input of the output connector 98. As shown by the flow chart in FIG. 12, which describes the process to be executed by controller 92A, at the start of printer operations, the voltage level of terminal input i2 is checked. If it is low (L), i.e., connected to ground through terminal 63A of connector 63, then the printer type is looked-up in table 1 at step 102. If terminal input i2 is high (H), then subprinter 60 is not installed. A printer type detection terminal set 63B is also provided in input connector 63. Output connector 98 is also provided with terminal inputs corresponding to printer type detection terminal set 63B of input connector 63; the corresponding terminal inputs being respectively connected to input terminals i0 and i1 of controller 92A. Printer 5 can therefore also detect what type of subprinter is installed by detecting the voltage level of these terminals 63B through terminal inputs i0 and i1 of the controller 92A. Note that the "printer type" used herein includes both the types of printer mechanisms, e.g., thermal, impact, ink jet and laser type print mechanisms, and the type of printer application, e.g., journal printing, label printing, validation printing and slip printing. The voltage levels of terminal inputs i0 and i1 are affected by terminal set 63B when connector 63 is installed in output connector 98. The voltage levels of terminals 63B are controlled by switches on dip-switch Dip-SW which has switch inputs tied to ground. At step 102 in the flow chart in FIG. 12, the voltage levels on i0 and i1, as determined by the dip-switch settings, determine the printer type which can be stored in a look-up table, e.g. a memory, in controller 92A. In the example shown, the level of input terminal i0 is used to detect the type of printing mechanism, e.g. thermal or impact, and i1 detects the application type of the attached subprinter, e.g. journal or label. By thus determining what type of subprinter is connected, printer 5 can appropriately control the printing process according to the printer type by means of controller 92A.

Figure 5:
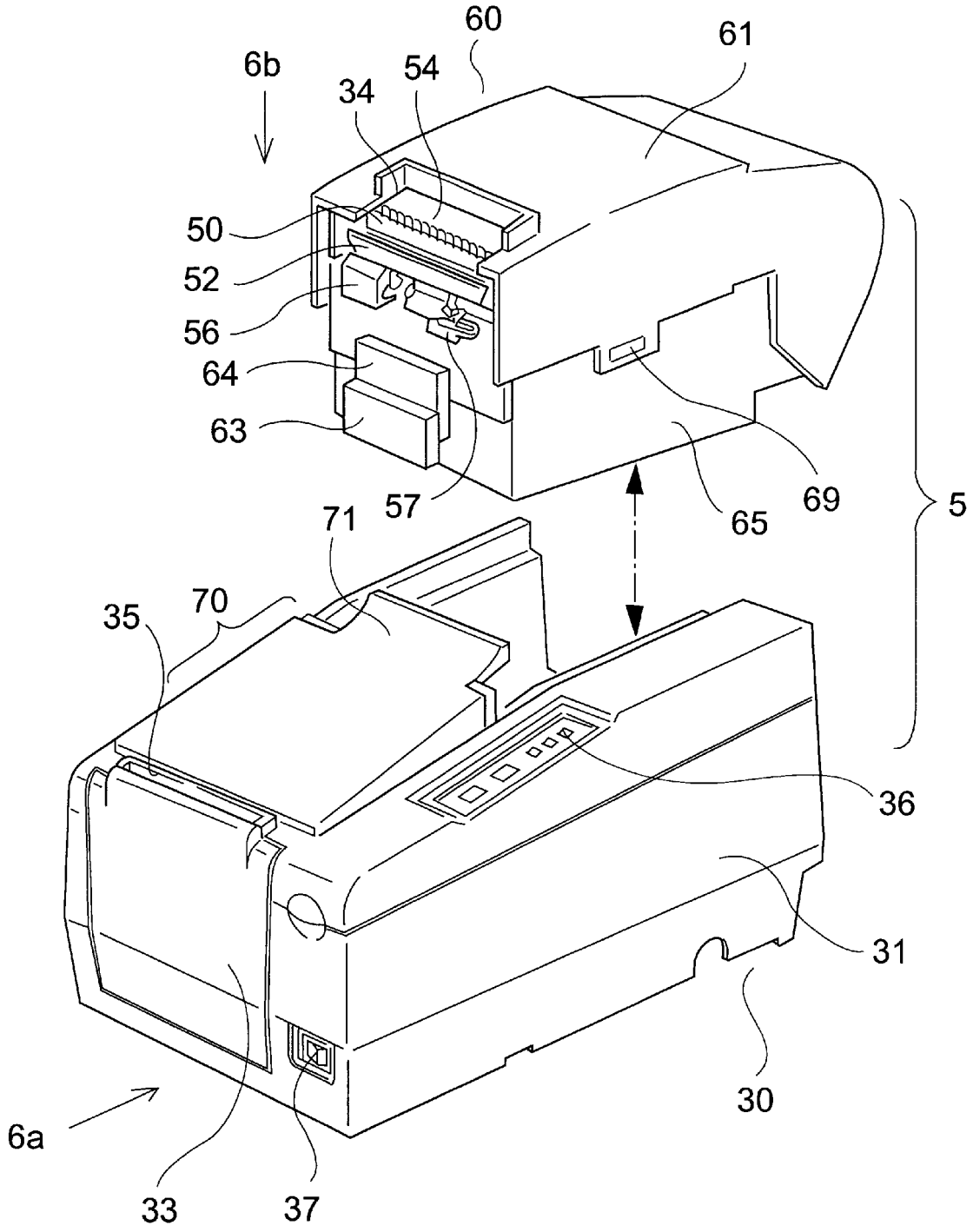
FIG. 5 is an overview of the printer shown in FIG. 1 with the journal printer thereof separated from the printer main housing.

FIG. 5 shows the printing apparatus when journal printer 60 is removed from main bottom housing 31 of printer 5. Because journal printer 60 can be removed from printer 5 as a complete assembly, the user can easily change the type of journal printer 60 used. For example, while the same thermal head circuit board 52 is used in the printing mechanisms of both the journal printer 60 and receipt printer 70 in printer 5 in this embodiment, it may be preferable to print multiple journal copies if the data printed in the journal is used for multiple purposes, such as accounting and inventory control. In such cases a wire dot impact type printing mechanism may be preferable for the printing mechanism 50 of the journal printer 60.

This can be easily accomplished using printer 5 according to the present embodiment by simply changing journal printer 60 from a thermal transfer type printer to an impact type printer, thereby achieving a printer 5 with the subprinter combination desired for the user's application. With a multiple function printer 5 according to the present embodiment, therefore, it is not necessary to assemble printer 5 according to user requirements in the factory, and the printer functions desired by the user can be assembled at the time of delivery to the customer to provide a multiple function printer featuring the specifically desired functions. It is also possible to freely change the printer type after the printer is delivered to the user when the operating environment or printing needs change.

The multiple function printer according to the present embodiment therefore enables flexible system configuration, and can be provided at a low cost in a short time because complex, flexible production lines are not needed.

It is also possible to store journal printer 60 containing journal paper imprinted with valuable sales information inside a safe or other secure location after the store closes for the day. When opening the next day it is only necessary to replace journal printer 60 in main bottom housing 31, and the relatively time-consuming, troublesome steps of installing roll paper and feeding the paper to the take-up reel 22 can be eliminated.

Figure 6:
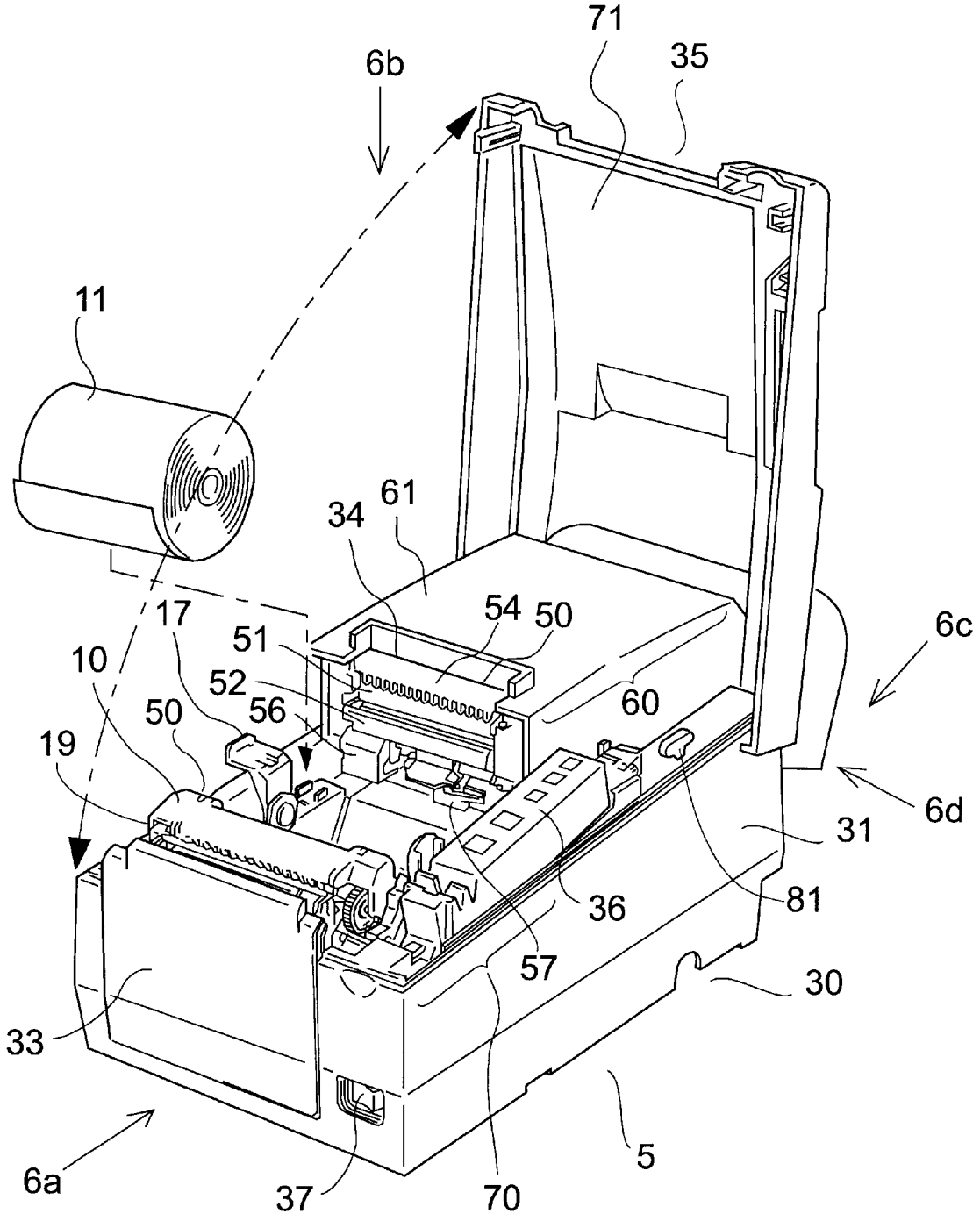
FIG. 6 is an overview of the printer shown in FIG. 1 with the top housing of the receipt printer of the printer open.

In FIG. 6 journal printer 60 is shown installed in main bottom housing 31 with top housing 61 of journal printer 60 locked closed to bottom housing 31 and top housing 71 of receipt printer 70 open. As described above, consumption of roll paper 11 in receipt printer 70 is greater than that in journal printer 60, and the roll paper in receipt printer 70 must therefore be replaced more frequently. This is accommodated in printer 5 according to the present embodiment by providing separate top housings 71 and 61 for receipt printer 70 and journal printer 60, respectively, so that the paper for receipt printer 70 can be replaced by opening only top housing 71 for receipt printer 70. Roll paper 11 in receipt printer 70 can therefore be replaced as shown in FIG. 6 by simply rotating the front of top housing 71 up from front 6*a* toward the back.

It is therefore only necessary to open the section in which roll paper must be replaced, i.e., receipt printer 70 in the example shown in FIG. 6, when it is necessary to replace the roll paper in printer 5 according to the present embodiment. The appearance of serious trouble with the printer is thus avoided even if the roll paper must be replaced in front of customers because only part of printer 5 is opened. This creates a better impression while also preventing exposure of past sales data recorded to the journal paper.

Loss of important data and similar problems resulting from the operator mistakenly replacing the roll paper for journal printer 60 are also avoided because top housing 61 of journal printer 60 is locked to bottom housing 31 by locking mechanism 81. Other problems that may arise from dust and other foreign matter entering journal printer 60 when replacing the receipt printing paper are also avoided because the journal printer cover is not opened.

Note, also, that with printer 5 according to the present embodiment top housing 71 of receipt printer 70 does not open by pivoting at some point near receipt printer 70 but by pivoting on main bottom housing 31 at a position remote from receipt printer 70, i.e., near back 6*d* of journal printer 60, in the same manner as top housing 61 of journal printer 60. When top housing 71 thus opens, top housing 71 rotates over or to the back of journal printer 60, and a wide area free of top housing 71 is assured above receipt printer 70. As a result the printer is easy to maintain, enables paper to be easily replaced.

As described above, roll paper must be replaced and paper jams and other maintenance are needed more frequently with receipt printer 70 than journal printer 60. These needs are accommodated by placing receipt printer 70 at the front of printer 5 and opening top housing 71 from about the same pivot position as top housing 61 of journal printer 60 located behind receipt printer 70 in the present embodiment, thereby achieving a printer that is easy to maintain and protects valuable data.

As described above, the printer of the invention enables easy maintenance of receipt printer 70 while simultaneously enabling easy maintenance of journal printer 60 when it is needed. More specifically, if both top housing 71 of receipt printer 70 and top housing 61 of journal printer 60 are opened at the same time, all of the component parts are exposed on a single plane and can be easily accessed because receipt printing section 10, receipt printing roll paper housing 17, journal printing section 20, journal printing roll paper housing 27, and take-up reel housing 29 for printed journal paper take-up reel 22 are arranged in line. Access to the receipt printing section 10 of the printer 5 according to the present embodiment is also improved for paper jam removal and regular maintenance because housing front 33 is designed to open forward.

Paper jams in parts of journal printer 60 that are not easily accessible from the top can also be easily removed by simply removing journal printer 60 from main bottom housing 31 because the journal printer 60 can be removed as a single complete assembly.

Figure 7:
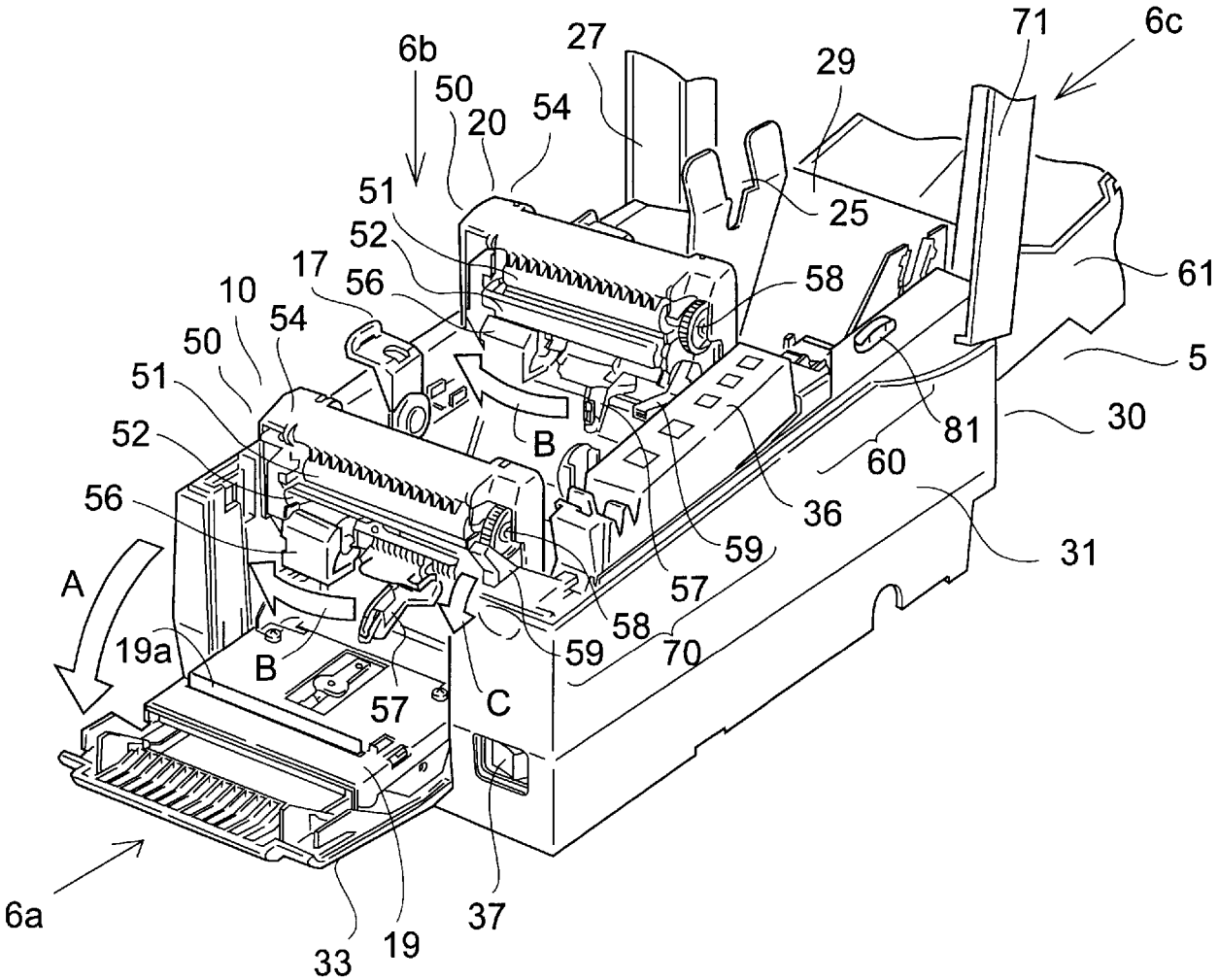
FIG. 7 is an overview of the printer shown in FIG. 1 with the front housing thereof open.

The appearance of printer 5 when the printer is opened to access the inside for paper jam removal, to correct other problems, or for maintenance is shown in FIG. 7.

When top housings 61 and 71 are opened upward, each of the major components inside printer 5 can be seen. When housing front 33 is then opened forward, automatic paper cutter 19 is exposed and any paper jams therein can be easily removed. When automatic paper cutter 19 is rotated forward in the direction of arrow A, printing means 50 disposed in the receipt printing section 10 is almost completely exposed. When lever 57 of thermal head circuit board 52 is then turned forward in the direction of arrow B, thermal head circuit board 52 drops forward to open the recording medium path. Any paper pieces or paper jams between thermal head circuit board 52 and platen roller 51 can thus be easily removed.

The motor and platen roller 51 are also disengaged by rotating release lever 59 on the right side of platen roller 51 in the direction of arrow C, thereby enabling platen roller 51 to be rotated easily by turning knob 58, which is also on the right side. It is therefore also easy to remove paper jams from the vicinity of platen roller 51. Because the same printing mechanism 50 is used for both receipt printing section 10 and journal printing section 20 in printer 5 according to the present embodiment, paper jams can be removed from both subprinters using the same procedure.

All manually operated levers and knobs are also provided on the same side of the printer, i.e., the right side as seen from front 6*a* in the present embodiment. It is therefore simple for the operator to correct paper jams and similar problems with the printer according to the present embodiment, thereby continuing service without keeping customers waiting.

Figure 8:
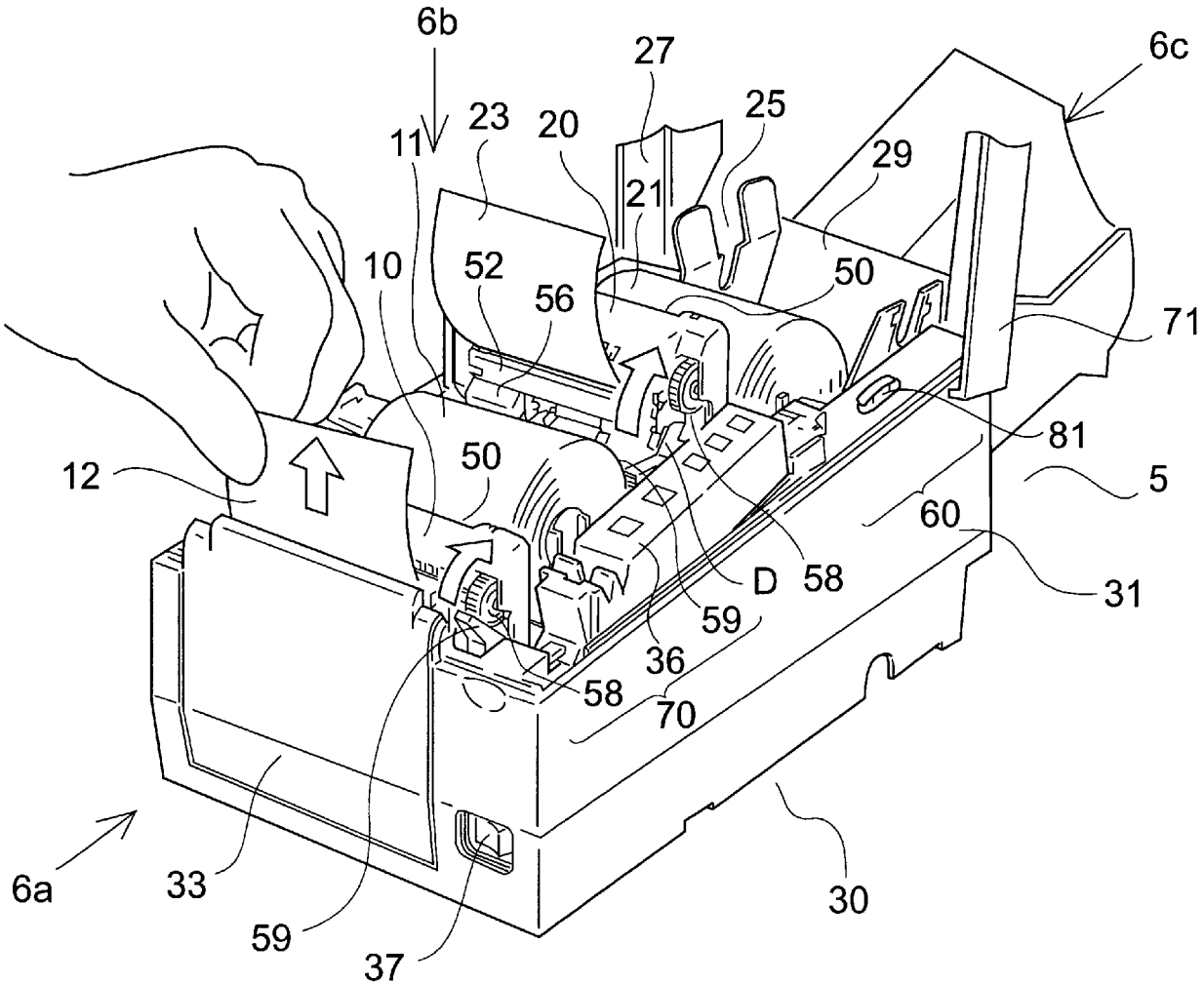
FIG. 8 is an overview of the printer shown in FIG. 1 used to describe how roll paper is loaded into the printer.
Figure 9:
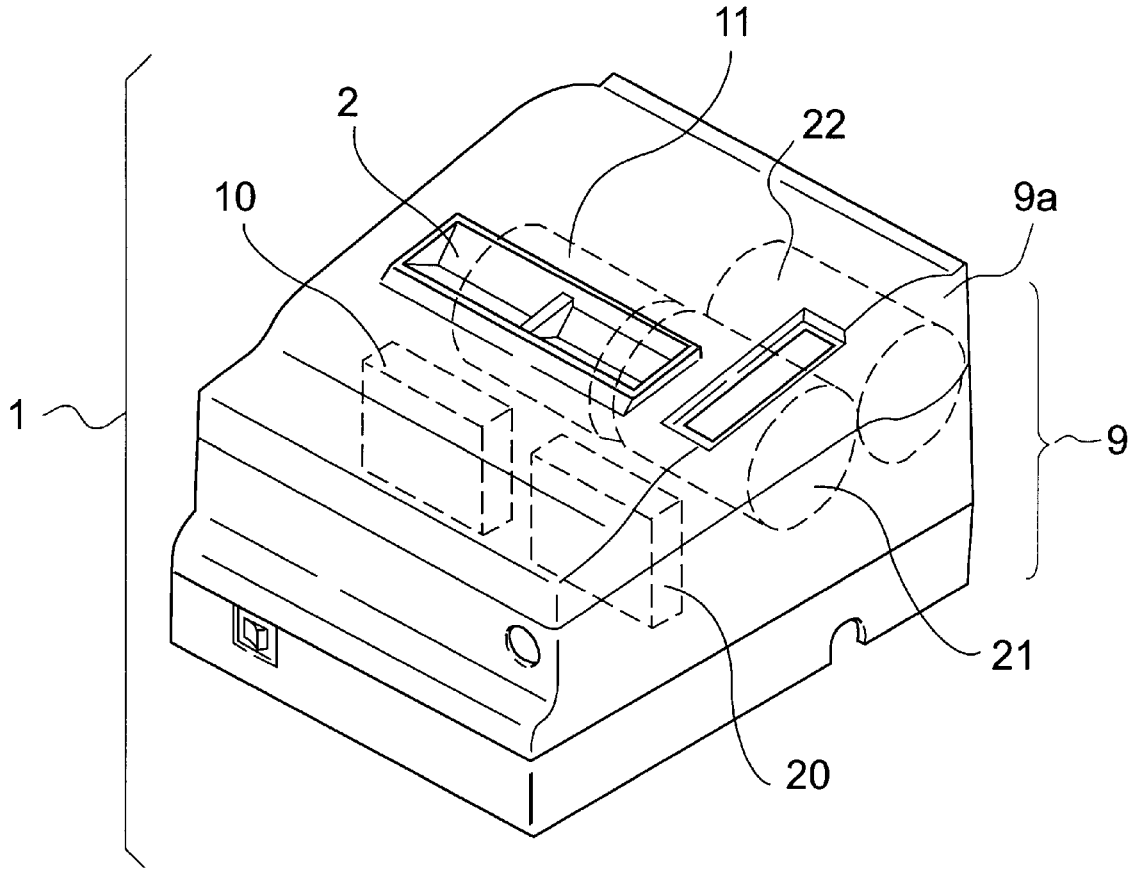
FIG. 9 is an overview of a conventional printer in which the receipt printing and journal printing means are disposed side by side horizontally.

The procedure for installing roll paper to journal printer 60 and receipt printer 70 is shown in FIG. 8. The first step is to open top housing 71 or 61, and then set roll paper 11 or 21 in roll paper housing 17 or 27, respectively. Lever 59 on the right side of printing means 50 is then pulled forward to free platen roller 51 from the motor. By then turning knob 58 to manually rotate platen roller 51, receipt paper 12 or journal paper 23 is pulled from roll paper 11 or 21 through the recording medium path to the correct position. The process for setting the printing paper in position is the same for both receipt paper 12 and journal paper 23, and release lever 59 and knob 58 are operated in the same direction for both the receipt printing section 10 and journal printing section 20.

The lengthwise in-line arrangement of the receipt printing section 10, roll paper 11, journal printing section 20, roll paper 21, and take-up reel 22 in printer 5 according to the present embodiment also realizes a flat, narrow printer. As a result the printer is compact and easy to maintain, enables paper jams to be quickly resolved, and enables paper to be easily replaced. While receipt printer 70 also requires frequent roll paper replacement, this design improves receipt printer maintenance performance, thereby enabling service to be resumed more quickly when a problem does occur so that customers are not kept waiting. As a result, printer 5 is ideally suited as a printer for POS stations.

In a printing apparatus in which the receipt printer and journal printer are arranged vertically in-line, problems caused by paper chaff in one printing means can also result in problems in the other printing means. With printer 5 according to the present embodiment, however, the lengthwise or longitudinal in-line arrangement of the receipt printing section 10 and journal printing section 20 prevents such chaff in one subprinter from creating problems in the other subprinter, in addition to providing excellent maintenance characteristics and reducing printer size. Because the receipt printing section 10 and journal printing section 20 are not stacked one above the other in the printer of the invention, the printed content can be easily viewed from above the printer in both printing sections.

As discussed, receipt printer 70 and journal printer 60 are installed in line in printer 5 of the present embodiment. More specifically, receipt printing section 10, receipt printing roll paper housing 17, journal printing section 20, journal printing roll paper housing 27, and journal printing roll paper housing 27 for printed journal paper take-up reel 22 are arranged in line from front 6*a* to back 6*c*. As a result, a narrow, compact multiple function printer 5 comprising two print functions, specifically receipt printing and journal printing, can be achieved.

It is also possible to achieve a multiple function printer with the maintenance characteristics and other features of the in-line printer arrangement described above in a printer in which receipt printer 70 and journal printer 60 are placed laterally side by side with the top housing for the receipt printer and the top housing for the journal printer both disposed to pivot open at a position removed from the receipt printer, i.e., at the outside edge of the journal printer. However, arranging the journal printer 60 and receipt printer 70 one behind the other as described in printer 5 of the above embodiment achieves a narrow printer 5 in which space to house a take-up reel can be easily incorporated without wasting space. It can therefore be concluded that arranging plural printers in line front-to-back is a more efficient means of reducing the size of such a multiple function printer, and achieves a narrow printer that can be easily incorporated with a cash drawer, personal computer, and display to assemble a POS station.

This long, narrow shape also makes it easier to install the printer in spaces on the side or along the edges of the POS installation area. The printer of the invention can thus be easily combined with other components to assemble a POS station, and can be used to efficiently construct a multiple function POS station in a confined area.

It should be noted that take-up reel housing 29 can be provided either before or after journal printing section 20, but it is preferable to place take-up reel housing 29 behind journal printing section 20 as described above to enable the printed information to be seen or written on through monitor window 34. Operation is also improved by placing receipt printer 70 at the front 6*a* for easier access to the printed receipts that must be handed to the customer. The printer of the invention is thus compact, easy to use, and suitable for assembling POS stations.

Take-up reel housing 29 and journal printing roll paper housing 27 are also disposed in this same flat, in-line arrangement to reduce the height of printer 5 in the present embodiment. Roll paper 21 and take-up reel 22 housed in roll paper housing 27 and take-up reel housing 29 are, however, replaced at the same time, and it is therefore possible to arrange these two housings one above the other. Other than slightly increasing the overall height of printer 5, this arrangement makes it possible to provide a narrow and even shorter printer 5 while having no affect on either the maintenance or operation of printer 5.

It should be further noted that while the present invention has been described using by way of example a printer equipped with both receipt printing and journal printing functions for use as a POS printer, the present invention shall not be limited to application with POS printers. For example, the printer according to the present invention can be applied to a printing apparatus comprising printing means using different printing mechanisms, e.g., a thermal printer and a dot matrix impact printer, to reduce the size of the overall printing apparatus while maintaining good maintenance and operation characteristics by arranging the two printing means and the space in which the corresponding recording media are stored longitudinally in-line.

A narrow, compact printer can also be achieved in printers that use cut-sheet forms instead of roll paper by using the longitudinal in-line arrangement of the present invention.

Furthermore, while the present invention has been described using by way of example a dedicated POS printer, the invention can also be applied to integrated apparatuses combining the respective functions of a cash drawer, personal computer and display, and printer. By providing separate covers (top housings) for the receipt and journal printing units with both covers hinging open from the journal printing unit side, different printing functions can be compactly provided in the confined space inside such integrated apparatuses while retaining the maintenance and operating characteristics described above.

It should also be noted that while the invention has been described above combining a receipt printer and journal printer, the invention shall not be so limited. The invention can, for example, be applied to combine a receipt printer and a label printer, a journal printer and a label printer, or various other printer types according to the specific application. In addition, while a thermal transfer printer has been used by way of example for the printing mechanism above, dot impact printers, ink jet printers, and other common printing mechanisms can also be used. Furthermore, different types of printing mechanisms can be used for the first and second printing units. It will be obvious that these and other variations and applications can be easily achieved by those skilled in the art from the above disclosure of the invention.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printing apparatus comprising plural printing units for printing on respective plural recording media, each of said plural printing units comprising a respective printing mechanism including a respective recording medium transportation means for transporting said respective recording medium, a respective printing means for printing on said respective recording medium, and a respective platen opposing said respective printing means with said respective recording medium disposed therebetween, said printing apparatus further comprising:

a first main housing for housing the plural printing units, and wherein a first printing unit of the plural printing units comprises a second housing for housing at least said respective printing mechanism, and removal means for enabling complete removal of said second housing from said first main housing.

2. The printing apparatus according to claim 1, wherein the first printing unit comprises a recording medium storage means for storing the respective recording medium.

3. The printing apparatus according to claim 2, wherein the first printing unit further comprises a printed medium storage means for storing the respective recording medium after printing.

4. The printing apparatus according to claim 3, wherein the first printing unit further comprises a cover for covering the respective recording medium transportation means at least from the respective printing means to the printed medium storage means, and means for opening and closing the cover on the second housing.

5. The printing apparatus according to claim 4, further comprising a print confirmation window provided in said cover for confirming the result of printing on the respective recording medium.

6. The printing apparatus according to claim 4, further comprising a keyed lock for prohibiting opening of said cover.

7. The printing apparatus according to claim 1, further comprising a common control means in common with the plural printing units for receiving data sent from a host device, and wherein the first printing unit comprises a connecting means for connecting to the common control means for the input of print data from the common control means.

8. The printing apparatus according to claim 7, wherein the common control means comprises a connection detecting means for detecting whether the connecting means is connected.

9. The printing apparatus according to claim 8, wherein the connection detecting means comprises a printing unit detection means for detecting the type of the first printing unit.

10. The printing apparatus according to claim 7, wherein the connecting means is fixed to the second housing of the first printing unit such that when the first printing unit is installed in the first main housing the connecting means is connected to the common control means.

11. The printing apparatus according to claim 1, wherein the plural printing units are arranged in line with each other inside the first main housing.

12. The printing apparatus according to claim 1, wherein the printing mechanisms of the plural printing units are interchangeable.

13. The printing apparatus according to claim 1, wherein the printing mechanisms of the plural printing units are each different types of printing mechanisms.

14. A printing unit for use in a printing apparatus comprising plural printing units, a common control means in common with the plural printing units for receiving data sent from a host device, and a first main housing for housing the plural printing units and the common control means, and wherein said printing unit comprises:

a recording medium transportation means for transporting a recording medium, a printing means for printing on said recording medium, and a platen opposing said printing means with said recording medium disposed therebetween;

a second housing for housing at least the recording medium transportation means, printing means, and platen;

means for enabling complete removal of said second housing from said first main housing; and a connecting means for connecting to the common control means for the input of print data from the common control means.

15. The printing unit according to claim 14, further comprising a recording medium storage means for storing the recording medium.

16. The printing unit according to claim 15, further comprising a printed medium storage means for storing the recording medium after printing.

17. The printing unit according to claim 16, further comprising a cover for covering the recording medium transportation path at least from the printing means to the printed medium storage means, and means for opening and closing the cover on the second housing.

18. The printing unit according to claim 17, further comprising a print confirmation window provided in said cover for confirming the result of printing on the recording medium.

19. The printing unit according to claim 17, further comprising a keyed lock for prohibiting opening of the cover.

20. A printing apparatus comprising:

plural printing units for printing on respective plural recording media, each of the plural printing units comprising a respective printing mechanism, and a first main housing for housing the plural printing units, and wherein a first printing unit of the plural printing units comprises a second housing for housing at least the respective printing mechanism, the second housing being detachably mounted to the first main housing.

21. The printing apparatus according to claim 20, wherein the first printing unit comprises a first recording medium housing which stores the respective recording medium before printing.

22. The printing apparatus according to claim 21, wherein the first printing unit further comprises a second recording medium housing which stores the respective recording medium after printing.

23. The printing apparatus according to claim 22, wherein the first printing unit further comprises a cover, disposed to enable opening and closing of the second housing, for covering at least the second recording medium housing.

24. The printing apparatus according to claim 23, further comprising a print confirmation window provided in the cover for confirming the result of printing on the respective recording medium.

25. The printing apparatus according to claim 23, further comprising a keyed lock for prohibiting opening of the cover.

26. The printing apparatus according to claim 20, further comprising a common control circuit in common with the plural printing units which receives data sent from a host device, and wherein the first printing unit comprises a connector, connected to the common control circuit, for inputting print data therefrom to the respective printing mechanism.

27. The printing apparatus according to claim 26, wherein the common control circuit comprises a connection detector which detects whether the connector is connected to the common control circuit.

28. The printing apparatus according to claim 26, wherein the common control circuit comprises a printing unit detector which detects the type of the printing mechanism of the first printing unit.

29. The printing apparatus according to claim 26, wherein the connector is fixed to the second housing of the first printing unit such that the connector is connected to the common control circuit when the first printing unit is installed in the first main housing.

30. The printing apparatus according to claim 20, wherein the plural printing units are arranged in line with each other inside the first main housing.

31. The printing apparatus according to claim 20, wherein the printing mechanisms of the plural printing units are interchangeable.

32. The printing apparatus according to claim 20, wherein the printing mechanisms of the plural printing units are each different types of printing mechanisms.

33. A printing unit for use as one of plural printing units in printing apparatus comprising a common control circuit in common with the plural printing units for receiving data sent from a host device, and a first main housing for housing the plural printing units and the common control circuit, and wherein the printing unit comprises:

a printing mechanism;

a second housing for housing at least the printing mechanism;

a connector detachably connected to the common control circuit for inputting print data therefrom to the printing mechanism;

wherein the printing mechanism is positioned at a front edge of the second housing.

34. The printing unit according to claim 33, further comprising a first recording medium housing which stores a recording medium before printing.

35. The printing unit according to claim 34, further comprising a second recording medium housing which stores the recording medium after printing.

36. A printing unit for use as one of plural printing units in a printing apparatus comprising a common control circuit in common with the plural printing units for receiving data sent from a host device, and a first main housing for housing the plural printing units and the common control circuit, and wherein the printing unit comprises:

a printing mechanism;

a second housing for housing at least the printing mechanism;

a connector detachably connected to the common control circuit for inputting print data therefrom to the printing mechanism;

a first recording medium housing which stores a recording medium before printing;

a second recording medium housing which stores the recording medium after printing; and a cover, disposed to enable opening and closing of the second housing, for covering at least the second recording medium housing.

37. The printing unit according to claim 36, further comprising a print confirmation window provided in the cover for confirming the result of printing on the recording medium.

38. The printing unit according to claim 36, wherein the cover comprises an engaging section allowing the cover to be locked to the first main housing when the printing unit is installed in the first main housing.

39. A printing apparatus comprising:

plural printing units for printing on respective plural recording media, each of the plural printing units comprising a respective printing mechanism, and a first main housing for housing the plural printing units so that the plural printing units are arranged in line backward and forward with each other, and wherein a first printing unit of the plural printing units comprises a second housing for housing at least the respective printing mechanism, the second housing being detachably mounted to the first main housing.

40. The printing apparatus according to claim 39, wherein one of the plural printing units is a receipt printer for receipt printing and the first printing unit is arranged behind the receipt printer.

41. The printing apparatus according to claim 40, wherein the receipt printer is arranged in front among the plural printing units.

42. A printing unit for use as one of plural printing units in a printing apparatus comprising a common control circuit in common with the plural printing units for receiving data sent from a host device, wherein the common control circuit controls the operation of each of the plural printing units, and a first main housing for housing the plural printing units and the common control circuit, and wherein the printing unit comprises:

a printing mechanism;

a second housing for housing at least the printing mechanism; and a connector detachably connected to the common control circuit for inputting print data therefrom to the printing mechanism;

wherein the printing mechanism is positioned at a front end of the second housing.

43. A printing unit for use as one of plural printing units in a printing apparatus comprising a common control circuit in common with the plural printing units for receiving data sent from a host device, and a first main housing for housing the plural printing units and the common control circuit, and wherein the printing unit comprises:

a printing mechanism;

a second housing for housing at least the printing mechanism; and a connector detachably connected to the common control circuit for inputting print data therefrom to the printing mechanism;

wherein the printing mechanism is positioned at a front end of the second housing; and wherein the second housing comprises a first recording medium compartment disposed behind the printing mechanism, wherein the first recording medium compartment stores a recording medium to be printed.

44. The printing unit according to claim 43, wherein the second housing comprises a second recording medium compartment disposed behind the first recording medium compartment, wherein the second recording medium compartment stores a recording medium after printed.

45. A printing unit for use as one of plural printing units in a printing apparatus comprising a common control circuit in common with the plural printing units for receiving data sent from a host device, and a first main housing for housing the plural printing units so that the plural printing units are arranged in line backward and forward with each other and the common control circuit, and wherein the printing unit comprises:

a printing mechanism;

a second housing for housing at least the printing mechanism; and a connector detachably connected to the common control circuit for inputting print data therefrom to the printing mechanism.

46. A printing unit for use as one of plural printing units in a printing apparatus comprising a common control circuit in common with the plural printing units for receiving data sent from a host device, and a first main housing for housing the plural printing units and the common control circuit, and wherein the printing unit comprises:

a printing mechanism including a transportation mechanism that transports a recording medium;

a second housing for housing at least the printing mechanism; and a connector detachably connected to the common control circuit for inputting print data therefrom to the printing mechanism;

wherein the printing mechanism is positioned at a front end of the second housing.

* * * * *